US005388925A

United States Patent [19]

Wilcox et al.

[11] Patent Number: 5,388,925

[45] Date of Patent: Feb. 14, 1995

[54] FINE POINT TIP APPLICATOR FOR CRAFT PAINT

[75] Inventors: Reed N. Wilcox, Littleton; Richard L. George, Englewood, both of Colo.; William H. Lichfield, Corinne, Utah

[73] Assignee: The Flagship Group II, Inc., Englewood, Colo.

[21] Appl. No.: 888,055

[22] Filed: May 22, 1992

[51] Int. Cl.[6] ..... B43K 8/14; B65D 47/18

[52] U.S. Cl. ..... 401/261; 222/420; 222/566; 222/575; 401/265

[58] Field of Search ..... 222/566, 568, 420, 215, 222/575; 401/261, 262, 265, 247

[56] References Cited

U.S. PATENT DOCUMENTS

| | | | |
|---|---|---|---|
| 2,165,860 | 7/1939 | Killmeyer | 222/215 |
| 2,456,602 | 12/1948 | Welsh | 401/247 |
| 2,500,639 | 3/1950 | Lermer | 222/215 |
| 2,898,019 | 8/1959 | Williams | 222/568 X |
| 3,174,655 | 3/1965 | Hurschman | 222/386.5 |
| 3,248,017 | 4/1966 | Allen | 222/420 X |
| 3,552,605 | 1/1971 | Hein | 222/420 X |
| 4,526,490 | 7/1985 | Welsh | 222/215 |
| 4,616,768 | 10/1986 | Flier | 222/92 |
| 4,917,274 | 4/1990 | Asa et al. | 222/420 |
| 5,105,985 | 4/1992 | Kroeber | 222/92 |

FOREIGN PATENT DOCUMENTS

| | | | |
|---|---|---|---|
| 114007 | 7/1984 | European Pat. Off. | 222/420 |
| 0276198 | 7/1988 | European Pat. Off. . | |
| 829092 | 6/1938 | France | 222/420 |
| 1018211 | 12/1952 | France | 222/420 |
| 482552 | 7/1953 | Italy | 222/568 |

*Primary Examiner*—Steven A. Bratlie

*Attorney, Agent, or Firm*—Dorr, Carson, Sloan & Peterson

[57] ABSTRACT

A fine applicator tip for a craft paint applicator for use in creating stylized textured designs. In a preferred embodiment, the applicator tip includes a parabolically-shaped inner passage to deliver the craft paint in a laminar flow with minimal flow resistance. This permits easy flow of the craft paint from the applicator with minimum hand fatigue. The size of the outside diameter of the surface of the dispensing end is critical for fine point application and for the craft paint flow to be uniform without adhering to the end surface of the dispensing end of the applicator tip. The thin sidewall thickness allows the dispensing end to be formed with a fine-tip and still have adequate rigidity. The applicator tip is formed with a reverse-threaded portion to affix the applicator tip onto an applictator. This allows the applicator to be easily removable for cleaning or replacement while prevents the applicator tip from being inadvertently removed.

1 Claim, 4 Drawing Sheets

Fig. 3
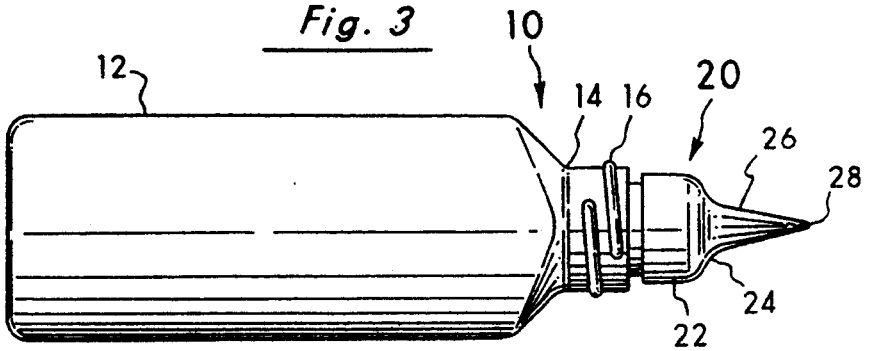
Fig. 4
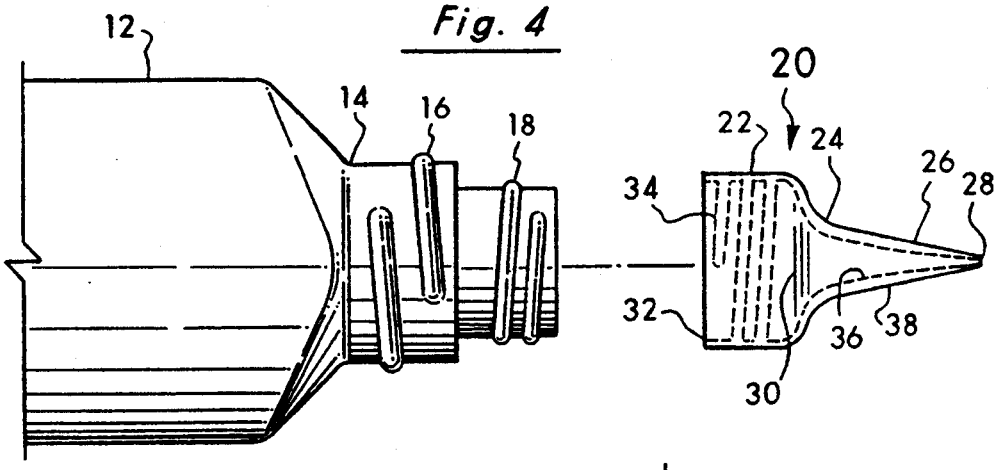
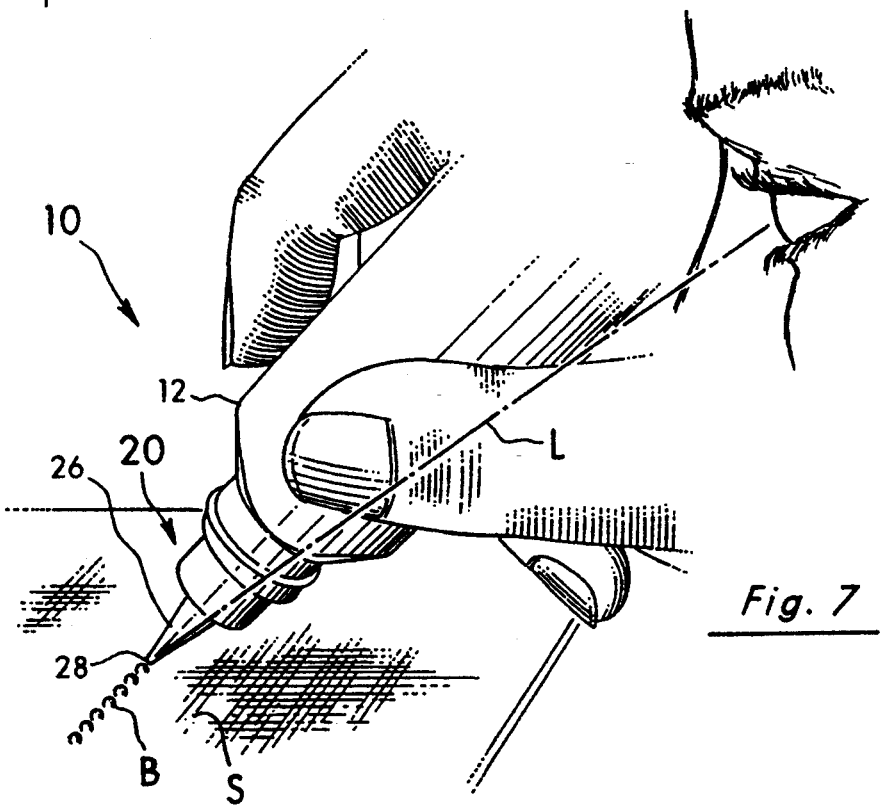
Fig. 7

FINE POINT TIP APPLICATOR FOR CRAFT PAINT

BACKGROUND OF THE INVENTION

1. Related Inventions

| TITLE | Ser. No. | FILING DATE | U.S. Pat. No. |
|---|---|---|---|
| Inverted Cap For Craft Paint Applicators | 07/888,552 | May 22, 1992 | 5,263,787 |
| Self Adjusting Soft Seal Cap For Fine Point Craft Paint Applicators | 07/888,059 | May 22, 1992 | 5,340,228 |
| Craft Paint For Forming High Resolution Designs | 07/887,699 | May 22, 1992 | abandoned |
| Craft Paint System For Forming Fine Designs and Method Therefor | 07/887,289 | May 22, 1992 | 5,209,663 |

2. Field of the Invention

The present invention relates to the field of applying craft paint and, more particularly, to the field of using fine point, easy flow applicator tips for craft paint to form painted designs with a finely detailed, color dot matrix having a high degree of resolution and color saturation.

3. Statement of the Problem

There is great interest in forming stylized decorative designs on surfaces, such as fabrics, wood, leather, painted surfaces, and vinyl surfaces as well as other surfaces, through the use of craft paints. Craft paints are widely used since a colorful design can be quickly created on a variety of surfaces. In craft painting, the design is not usually limited to a pattern since normally the design is painted quickly in a free hand style. The free hand style design can thus be creative and colorful. Alternatively, craft painting can be applied by the use of patterns to create a particular design.

One novel application of craft paint, set forth in the above related inventions, is the creation of stylized decorative designs on a surface by applying uniform three dimensional discrete beads closely spaced together to form a color dot matrix pattern that visually merges together to form a solid line or field of color having a high degree of resolution and color saturation. One such design is illustrated in FIG. 1. The design is created on a fabric surface 2 by a plurality of beads 6 of differing colors. Each of the beads 6 have a uniform homogenous shape, as shown in FIG. 2 to provide a dimensional, textured appearance. The term "uniform" as used herein refers to beads having a regular size and a smooth substantially rounded spherical shape. A fine tip, easy flow applicator tip having an outside diameter at the dispensing end of less than about 0.060 inches and a sidewall thickness of less than about 0.015 inches is required in order to create the beads 6 shown in FIG. 2.

Conventionally, craft paints are provided in applicators having either tubular or conically-shaped tips. The craft paint is applied directly on the application surface from the applicator through these applicator tips. Such conventional applicators are suitable for free style designs, but are not suitable for fine detail work, especially involving the application of discrete beads necessary for dimensional textured appearances as shown in FIGS. 1 and 2.

Conventional tubular applicator tips are used in situations requiring a finely detailed application. Tubular tips normally have a cylindrically shaped tip with an outside diameter greater than 0.080 inches and sidewall thicknesses greater than 0.025 inches and a relatively long length to provide a line of sight for the user to create patterned designs. Tubular tips provide an improved line of sight application but have other drawbacks. The small inner diameter coupled with the length of the tubular tip results in a long narrow inner passage and, therefore, creates a problem with the flow resistance of the paint flow.

Flow resistance is caused by the shear forces of the paint flow in a long, small diameter passageway. The flow resistance causes several problems with the application of craft paint. A first problem is the hand fatigue of the user in forcing the paint against the flow resistance. Greater forces are necessary to overcome the flow resistance against the paint. The narrower the passageway and/or the longer the passageway, the greater the force. This increased force requires greater hand pressure against the applicator by the user which leads to hand fatigue. This detracts from the enjoyment of creating the stylized design. A second problem is the greater susceptibility to clogging within the applicator tip. If the paint partially dries within the applicator tip or if impurities or other objects in the paint occur, the flow resistance is increased even more since there is no room available for the paint to flow around any blockage. A third problem arising from the flow resistance occurs in the rheology of the paint. The flow characteristics of the craft paint changes as the shear forces in the paint flow increase. Increases in the shear forces cause the paint to become thinner, i.e. the paint viscosity is lowered. The change in viscosity changes the character of the paint. For instance, thinner paint will not form beads as well as thicker paint, nor will the application of the paint be as uniform. These are critical factors in the application of craft paint in uniform discrete three-dimensional beads as necessary for creating finely detailed structured designs.

Conventional conically-shaped tips minimize these effects caused by shear forces on the paint flow. Since the inner passage- way of a conically-shaped applicator tip only narrows down at the dispensing end of the applicator tip, the shear forces are much smaller and the flow resistance is lowered. Thus, the problems with hand fatigue and changes in the craft paint rheology are not major factors with the conically-shaped applicator tips when compared with tubular tips. However, conically shaped tips are not suitable for use with finely detailed designs. These applicators are designed to apply craft paint in a continuous linear fashion, such as stripes, not in discrete beads. The size and shape of the tips make it difficult to precisely position the tip and to apply small, discrete beads of craft paint in a uniform fashion to form a detailed pattern. The paint flow within the conically-shaped tips is often turbulent which causes spattering or lack of control of the paint or, to the application surface. This disrupts the creation of a finely detailed pattern.

Also, the conical shape of conventional craft paint applicator tips have thick sidewalls and provide inner surface areas for the craft paint to accumulate and dry, thus clogging the tips. The orifice size of the prior applicators typically must be of a relatively large diameter due to this clogging problem which permits more air into the passageway. As a result, the craft paint is applied in relatively large amounts through these orifices. The sizes of the orifices also are altered as the craft paint dries around and within the orifices. Hence, conically shaped applicator tips are not designed for fine-point work.

Many prior art applicator tips are affixed on the applicator by snapping or threading the applicator tips onto the applicator bottle, normally during the manufacturing process. These tips are usually not removable without considerable effort and with the possibility of damaging the tip. If these tips become clogged, as frequently occurs, the tips must be re-punctured with a sharp object which can affect the diameter of the tip orifice. If the prior tips become too damaged, then the entire applicator bottle and remaining paint may be rendered useless. Also, and more importantly, the clogging obstruction is pushed back into the bottle and may resurface later to again clog the tip.

It is clear that the aforesaid problems do not generally affect or interfere with the conventional free-style application of craft paint onto surfaces. However, when used for detailed designs especially the creation of discrete beads of craft paint for dimensional textured appearances as shown in FIGS. 1 and 2, all of the aforesaid problems arise and become critical to creating a desired design. Thus, a problem exists in that, at present, there is no craft paint applicator tip having an outside diameter at the dispensing end of less than about 0.060 inches with a sidewall thickness of about less than 0.015 inches. Such a tip provides a fine, consistent laminar flow for detailed designs such as application of discrete beads of craft paint for fine, dimensional appearances.

4. Solution to the Problem

The present invention solves this problem and others by providing a craft paint applicator tip that provides a fine, consistent laminar flow with reduced shear and one that is easily replaceable and cleanable.

The present invention includes an applicator tip having an inner parabolic shape with a smooth, clean finish to the interior sidewalls in order to provide laminar flow with reduced shear so as to provide easy flow for the craft paint.

The applicator tip of the present invention has a inner orifice shape to substantially eliminate air bubbles, air turbulence and drying of the craft paint within the tip.

The applicator tip of the present invention provides a small diameter dispensing orifice less than about 0.060 inches in outside diameter, with sidewalls in the range of about 0.005 to 0.015 inches to produce finely sized, uniformly shaped discrete beads of craft paint onto a desired surface.

The applicator tip of the present invention is designed not to be susceptible to clogging of the dispensing orifice of the applicator tip.

The applicator tip of the present invention provides a smooth laminar flow of craft paint with reduced shear to consistently form uniformly shaped beads with minimum pressure on the applicator by the user.

The applicator tip of the present invention is easily removable for cleaning or replacement purposes.

The applicator tip of the present invention includes a shape and size to enhance the line of sight of the application of the craft paint in discrete beads to form a pattern having a dimensional appearance on the desired surface.

These and other features of the present invention will be evident in the ensuing drawings and description.

SUMMARY OF THE INVENTION

The present invention provides a fine applicator tip for a craft paint applicator for use in creating stylized textured designs. In a preferred embodiment, the applicator tip includes a substantially cylindrical section with an externally tapering portion terminating in a fine-tipped dispensing end. The applicator tip includes a parabolically-shaped inner passage for the flow of the craft paint.

The size of the outside diameter of the surface of the dispensing end is less than about 0.060 inches. This is critical for precise, controlled paint flow which is uniform. The sidewall thickness of less than about 0.015 inches allows the dispensing end to be formed with a fine tip and still have an adequate opening size for paint to flow easily.

The parabolic shape of the inner passage which also has a smooth, clean finish, forms the craft paint in a substantial laminar flow with minimal flow resistance. Thus, rheology changes in the paint characteristics associated with shear effects are minimized. Also, hand fatigue is significantly lessened because of the reduced shear. The parabolic shape provides the laminar flow necessary for use in fine-tipped applicators.

The applicator tip is formed with a reverse-threaded portion to affix the applicator tip onto an applicator. This allows the applicator to be easily removable for cleaning or replacement. The reverse threading ensures that the applicator tip will not be unintentionally loosened or removed.

In the event of clogging or the presence of an obstruction, the applicator tip is easily removable to allow the tip to be cleaned. The clog or obstruction will not fall back into the bottle.

These features and others are discussed in the ensuing description of the drawings and of the preferred embodiment.

BRIEF DESCRIPTION OF THE DRAWINGS

FIG. 3 is a side view of a preferred embodiment of the applicator tip of the present invention.

FIG. 4 is an exploded view of the applicator tip of FIG. 3.

FIG. 5(*b*) illustrates the change in radius of the inner passageway of the applicator tip.

FIG. 7 is a perspective view illustrating the line-of-sight application of the applicator tip of FIG. 3.

DETAILED DESCRIPTION OF THE PREFERRED EMBODIMENT

Figure 1:
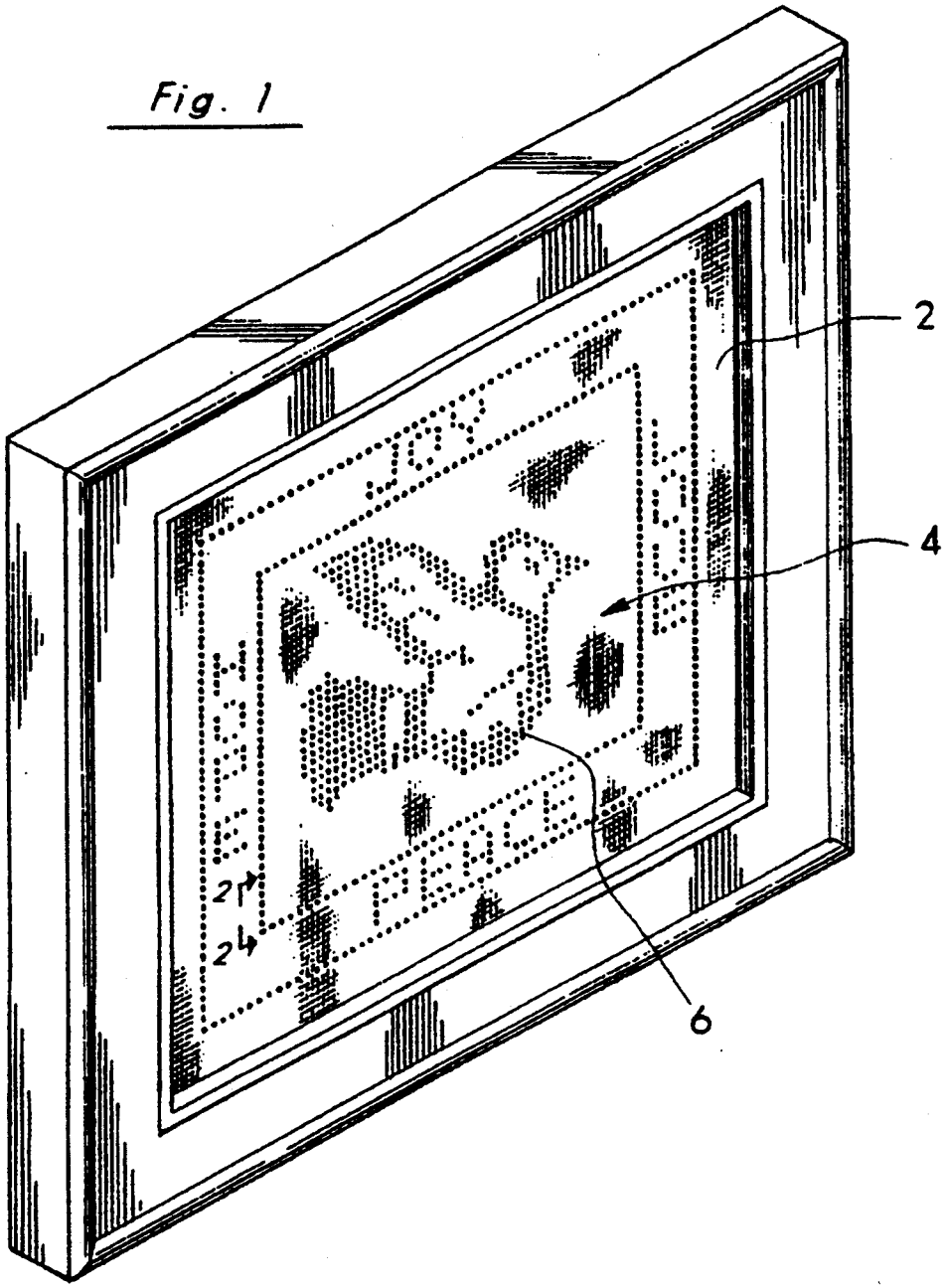
FIG. 1 illustrates a design created by the use of a fine point, easy flow craft paint applicator on which the applicator tip of the present invention has utility.
Figure 2:
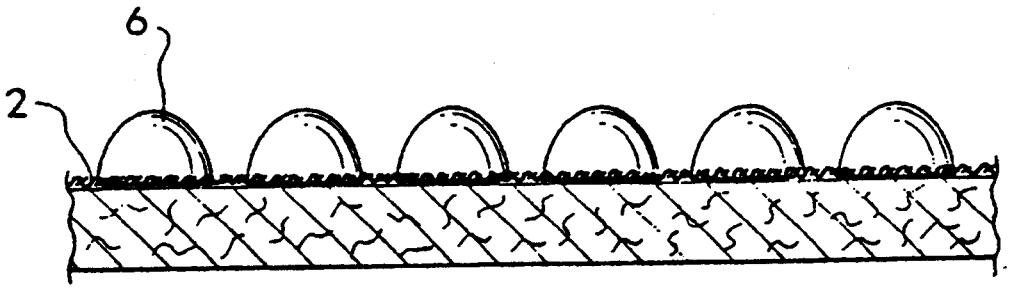
FIG. 2 is a cross-sectional view of the detail of a portion of the design of FIG. 1.

The present invention provides a fine, easy flow applicator tip for use in creating stylized textured designs, such as shown in FIG. 1 and discussed in the Background of the Invention. FIGS. 3–7 illustrate the preferred embodiment of the present invention. It is to be expressly understood that the descriptive embodiment set forth is intended for explanatory purposes only and is not meant to limit the scope of the present inventive concept. Other embodiments and variations are considered to be within the claimed invention.

1. Exterior Construction

Applicator 10, shown in FIGS. 3 & 4, includes an applicator bottle 12 having neck 14 with threaded portion 16 formed thereon. Threaded portion 16 is provided for conventional engagement with a cap, not shown, to seal the applicator. Applicator bottle 12 does not form part of the present invention and could be of various shapes and forms. However, a second threaded portion 18 is formed on neck portion 14 having reverse-threads. This feature is part of the present invention.

Applicator tip 20, shown in FIGS. 3 and 4, includes a substantially cylindrical section 22 with a tapering member 24 having an extended section 26 ending in dispensing end 28. Exterior wall 38, shown in FIG. 4, of section 26 has a linear, cone-shaped configuration. Applicator tip 20 also includes inner passage 30 for the flow of craft paint from the bottle 12 through to dispensing end 28. Substantially cylindrical portion 32 of inner passage 30 includes reverse threads 34 for mating engagement with reverse-threaded portion 18 of applicator bottle 12. The threads 18 are in the reverse direction of threads 16 so that the tip 20 is not moved with tightening or loosening of the cap.

The applicator tip in the preferred embodiment is of one piece molded construction and is molded from a suitable plastic transparent material. It is to be expressly understood that the tip could also be of multi-piece construction and, for example, the cylindrical portion 22 could be molded plastic having a slip on metal extended section 26.

2. Interior Construction

Figure 5A:
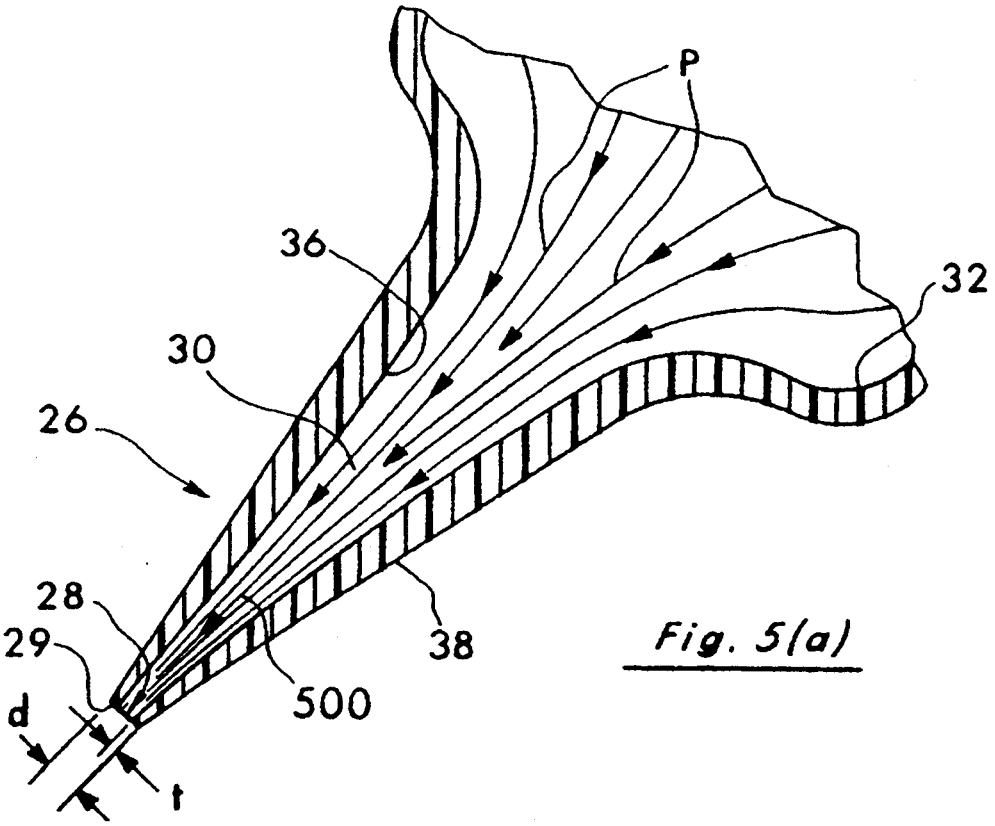
FIG. 5(*a*) illustrates the operation of the fine tip applicator to produce laminar flow.
Figure 5B:
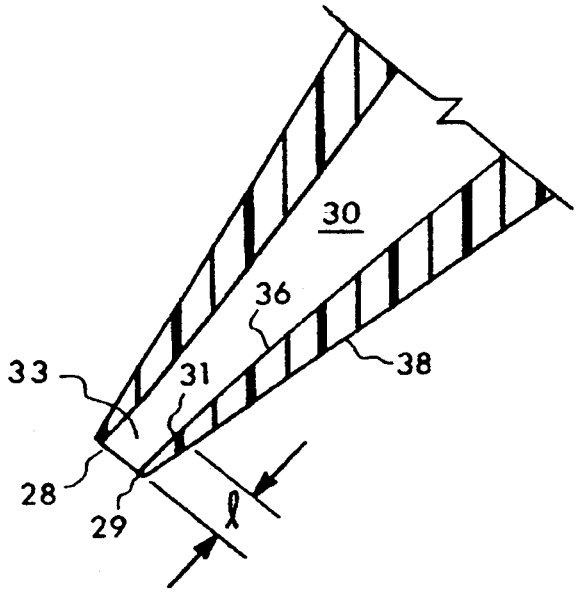

As shown in FIG. 5(*a*), inner passage 30 extends from a large diameter cylindrically-shaped portion 32 through an inner parabolic portion 36 to dispensing end 28. Also, the applicator tip must have some rigidity to form the finely detailed designs. The rigidity of the applicator tip is dependent not only upon the thickness of the sidewalls of the applicator tip but also on the ratio of the sidewall thickness to the overall circumference of the applicator tip. By reducing the overall circumference, the applicator tip allows the sidewall thickness to be reduced while maintaining adequate strength and rigidity in the applicator tip.

The parabolic shape of the inner sidewalls of portion 36 avoids the problems associated with the conventional tubular tips and conically-shaped tips which are of linear shape. Parabolic portion 36 introduces the flow into passageway 30 of tip 26. This creates a substantially laminar flow 500 in this portion as opposed to the turbulent flow in conventional conically-shaped applicator tips. Also, parabolic portion 36 minimizes the effects of shear (due to the laminar nature of the flow) associated with conventional tubular applicator tips.

In the preferred embodiment, applicator tip 20 has a sidewall thickness "t", at the dispensing end 28, in a range between about 0.005 to 0.015 inches thick. Preferably, sidewall thickness "t" is less than about 0.010 inches thick. As shown in FIG. 5(*b*), inner passageway 30 of applicator tip 20 changes radius at a distance "1" from dispensing end 28. In the preferred embodiment, "1" is between about 0.040 to 0.060 inches. Inner passageway 30 at point 31 angles to be substantially cylindrical (i.e., a substantially constant diameter equaling the diameter of the dispensing end.) This provides a smooth passageway 33 at the dispensing end as well as reducing the outside surface diameter of dispensing end 28 of applicator tip 20. This smaller diameter cylindrically-shaped passageway 33 further enhances the laminar flow of the craft paint out of the applicator tip.

Dispensing end 28 has an outside surface diameter "d" in the range of about 0.040 inches to 0.060 inches. Preferably the outside surface diameter "d" is 0.050 inches. The sidewall thickness diameter "t" and outside surface diameter "d" are critical to the performance of the fine tip applicator of the present invention. Outside diameter "d" of dispensing end 28 allows the craft paint to be applied in a fine, discrete bead. Craft paints applied with conventional applicator tips having outside surface diameters larger than 0.060 generally "migrate" or build up on the extreme end surface 29 of the applicator tip. Thus, the craft paint tends to flow out at the outside surface diameter "d" of the applicator tip. The present invention recognizing this migration problem reduces the outside diameter at the dispensing end as discussed next.

The sidewall thickness "t" is critical in order to form the dispensing end surface 29 with a small outside diameter while providing a sufficient inner diameter to reduce the shear effects of the flow resistance of the paint flow. The change in angle of passageway 30 of applicator tip 20 at point 31 for a distance of "1" from dispensing end 28 provides a tip having a small sidewall thickness (between about 0.005 and 0.015 inches) at end 29 which thickens to about 0.025 inches at a distance of "1" from the dispensing end. The interior sidewall of passageway 30 during the distance "1" is cylindrical in shape and the exterior sidewall 38 of tip portion 26 during the distance "1" is tapered. The sidewall thickness then gradually thickens as the inner passageway increases in diameter through the remainder of tip portion 26.

As clearly shown in FIG. 5(*a*), the flow 500 of the craft paint through the dispensing end 28 is substantially laminar. This is a direct result of having the parabolic shaped inner wall portion 36 and tapered inner wall section 36. An added benefit due to the contradistinction between the linear, cone-shaped configuration of the external wall 38 and the parabolic configuration of inner wall is the structural strength to the tip 26 (i.e., the sidewall thickness becomes greater from the end 28 towards the applicator).

4. Operation

Figure 6:
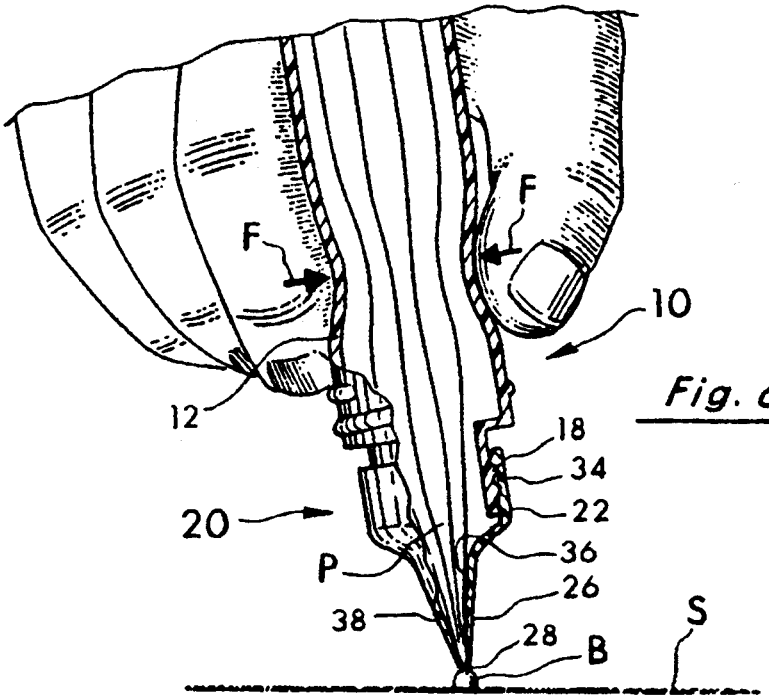
FIG. 6 is a cross-sectional view of the applicator tip of FIG. 3 in use.

The above features are operationally illustrated in FIG. 6. As applicator bottle 12 is pressed inward, the forces indicated by arrows "F" cause the craft paint to be pressured downward through applicator tip 20. As the flow "P" of the craft paint from the bottle encounters parabolic section 36 of applicator tip 20, the paint is directed into a substantially laminar flow with reduced shear. Thus, the turbulence associated with the conically-shaped tips is avoided. The substantial laminar flow "P" of paint is gradually constricted through tapered portion 38 to dispensing end 28. This minimizes the problem with shear being generated as occurs in the conventional tubular tips. Just prior to dispensing, the interior passageway is formed into a small diameter cylinder to enhance the laminar flow characteristic for a distance "1". The small outside surface diameter of dispensing end 28 allows the craft paint to be applied onto surface "S" in a small discrete bead "B".

The relative length of applicator tip 20 in combination with the fine dispensing end 28 of applicator tip 20 improves the line-of-sight "L", as shown in FIG. 7, of the application of the craft paint in discrete beads "B" on surface "S". Thus, not only are the problems associated with the conventional tubular tips and conically-shaped tips avoided, but the benefits of each are retained. The line-of-sight of applicator tip 20 of the present invention is greatly improved while the flow resistance of applicator tip 20 is minimal.

5. Reverse Threading

The reverse-threaded portion 18 of applicator bottle 12 and reverse-threaded portion 34 of applicator tip 20 are provided to allow applicator tip 20 to be easily removable. This allows applicator tip 20 to be removed for ease of cleaning applicator tip 20 and for replacement of applicator tip 20 should the tip be damaged. Applicator tip 20 is removed by turning, preferably in the clockwise direction. The applicator tip can then be cleaned from the inside out. This prevents any obstruction from falling back into the applicator bottle to resurface at a later time.

The use of reverse threads (i.e. engaging in a counterclockwise direction or the direction opposite the engagement of the cap) on the applicator tip and applicator bottle reduce the incidence of applicator tip 20 being unintentionally loosened or removed from applicator bottle 12. Since threaded portion 16 on applicator bottle is conventionally threaded, removal of the cap from applicator bottle 12 will not unintentionally remove applicator tip 20.

The present invention is thus able to provide an applicator tip for finely detailed designs requiring uniform, discrete, three-dimensional beads. The applicator tip of the present invention dispenses the craft paint in a laminar flow width minimal flow resistance (i.e., easy flow). The craft paint is capable of being applied in finely detailed patterns since the line-of-sight of the application is greatly enhanced. Additionally, the applicator tip is easily removable to allow cleaning or replacement of the applicator tip only when intended.

6. Conclusion

A fine, easy flow applicator tip 20 for a craft paint applicator 12 has been set forth in the above. A dispensing end 28 is formed on the end of the tip and has an outside diameter range of about 0.040 inches to 0.060 inches so as to provide a fine point for dispensing the craft paint. The tip 20 has a formed body 22, 24, 26 having a large diameter cylindrically-shaped inner hollow portion 32 containing the reverse threads 34. A formed small diameter cylindrically-shaped region 33 of predetermined length "l" is located at the dispensing end 28. And, an inner passageway 36 extending from the large diameter portion 22 to the small diameter portion 33 permits the craft paint to flow from the applicator through the body and out the dispensing end. This inner passageway 32 has formed substantially parabolic-shaped sidewalls 38 to reduce shear in the flow of the craft paint through the inner passageway and to further provide substantially laminar flow. This provides easy flow to the craft paint with minimum hand fatigue. The small diameter cylindrically-shaped portion 33 further enhances the laminar flow of the craft paint prior to flowing from said dispensing end 28. The small diameter cylindrically-shaped inner hollow portion has formed sidewalls at the dispensing end with a sidewall thickness in the range of about 0.005 to 0.015 inches. The sidewall thickness of the small diameter region increases from the dispensing end to about 0.025 inches at the predetermined length so as to provide structural rigidity to the sidewalls.

The present invention is not meant to be limited by the description of the above exemplary embodiment. The configuration of the applicator tip of the present invention encompasses other embodiments and variations as well as applied in a number of differing applications within the scope of the present inventive concept.

We claim:

1. A fine point, easy flow applicator tip for a craft paint applicator, said craft paint applicator containing craft paint, said applicator tip comprising:

means on a first end of said tip for removably affixing said tip on said craft paint applicator;

an integral dispensing end formed on the opposing second end of said tip, said dispensing end having an outside diameter in the range of about 0.040 inches to 0.060 inches so as to provide a fine point for dispensing said craft paint;

an integral body between said first and second ends, said body having a first formed large diameter cylindrically-shaped inner hollow portion containing said affixing means, a second formed small diameter cylindrically-shaped inner hollow portion at said dispensing end, and an inner passageway extending from said first inner hollow portion to said second inner hollow portion, said inner passageway having formed substantially parabolic-shaped sidewalls (i) to reduce shear in the flow of said craft paint through said inner passageway and (ii) to provide substantially laminar flow so as to provide easy flow to said craft paint; said second inner hollow portion having formed sidewalls at said dispensing end with a sidewall thickness in the range of about 0.005 to 0.015 inches, said second formed small diameter cylindrically-shaped inner hollow portion has a predetermined length and wherein the sidewall thickness increases from said dispensing end to about 0.025 inches at said predetermined length so as to provide structural rigidity to said formed sidewalls of said small diameter cylindrically-shaped inner hollow portion.

* * * * *